US005871206A

United States Patent [19]

McCharles

[11] Patent Number: 5,871,206

[45] Date of Patent: Feb. 16, 1999

[54] APPARATUS FOR ASSISTING THE LIFTING OF RIGID SHEET MATERIALS

[76] Inventor: Robert A. McCharles, Box 1443 Skidegate, British Columbia, Canada, V0T 1S1

[21] Appl. No.: 845,913

[22] Filed: Apr. 29, 1997

[51] Int. Cl.[6] ..... B66F 3/00

[52] U.S. Cl. ..... 254/123; 254/131

[58] Field of Search ..... 254/131, 129, 254/130, 120, 113–119, 8 B, 100, 94, 123

[56] References Cited

U.S. PATENT DOCUMENTS

| | | | |
|---|---|---|---|
| 640,120 | 12/1899 | Floyd | 154/123 |
| 1,307,600 | 6/1919 | Rose et al. | 254/8 B |
| 1,612,129 | 12/1926 | Huelsick | 254/100 |
| 1,666,971 | 9/1928 | McCarty | 254/94 |
| 1,721,227 | 7/1929 | Manley | 254/100 |
| 2,989,286 | 6/1961 | Gillespie | 254/120 |

*Primary Examiner*—Robert C. Watson

[57] ABSTRACT

A new Apparatus for Assisting the lifting of Rigid Sheet Materials for lifting and holding a sheet of wallboard or plywood in an elevated position above a bottom board so that it can be nailed in place. The inventive device includes a foot lever and fulcrum and an extendible lift arm pivotally attached thereto.

7 Claims, 3 Drawing Sheets

APPARATUS FOR ASSISTING THE LIFTING OF RIGID SHEET MATERIALS

BACKGROUND OF THE INVENTION

1. Field of the Invention

The present invention relates to tools for installing wallboard and plywood and more particularly pertains to a new Apparatus for Assisting the Lifting of Rigid Sheet Materials for lifting and holding a sheet of wallboard or plywood in an elevated position above a bottom board so that it can be nailed in place.

2. Description of the Prior Art

The use of tools for installing wallboard and plywood is known in the prior art. More specifically, tools for installing wallboard and plywood heretofore devised and utilized are known to consist basically of familiar, expected and obvious structural configurations, notwithstanding the myriad of designs encompassed by the crowded prior art which have been developed for the fulfill ment of countless objectives and requirements.

Known prior art tools for installing wallboard and plywood include U.S. Pat. No. 4,712,771; U.S. Pat. No. 4,868,943; U.S. Pat. No. 5,407,183; U.S. Pat. No. 4,826,390; U.S. Pat. No. 4,733,844 and U.S. Pat. No. 4,646,996.

While these devices fulfill their respective, particular objectives and requirements, the aforementioned patents do not disclose a new Apparatus for Assisting the lifting of Rigid Sheet Materials. The inventive device includes a foot lever and fulcrum and an extendible lift arm pivotally attached thereto.

In these respects, the Apparatus for Assisting the Lifting of Rigid Sheet Materials according to the present invention substantially departs from the conventional concepts and designs of the prior art, and in so doing provides an apparatus primarily developed for the purpose of lifting and holding a sheet of wallboard or plywood in an elevated position above a bottom board so that it can be nailed in place.

SUMMARY OF THE INVENTION

In view of the foregoing disadvantages inherent in the known types of tools for installing wallboard and plywood now present in the prior art, the present invention provides a new Apparatus for Assisting the Lifting of Rigid Sheet Materials construction wherein the same can be utilized for lifting and holding a sheet of wallboard or plywood in an elevated position above a bottom board so that it can be nailed in place.

The general purpose of the present invention, which will he described subsequently in greater detail, is to provide a new Apparatus for Assisting the Lifting of Rigid Sheet Materials apparatus and method which has many of the advantages of the tools for installing wallboard and plywood mentioned heretofore and many novel features that result in a new Apparatus for Assisting the Lifting of Rigid Sheet Materials which is not anticipated, rendered obvious, suggested, or even implied by any of the prior art tools for installing wallboard and plywood, either alone or in any combination thereof.

To attain this, the present invention generally comprises a foot lever and fulcrum and an extendible lift arm pivotally attached thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an project of the present invention to provide a new Apparatus for Assisting the Lifting of Rigid Sheet Materials apparatus and method which has many of the advantages of the tools for installing wallboard and plywood mentioned heretofore and many novel features that result in a new Apparatus for Assisting the Lifting of Rigid Sheet Materials which is not anticipated, rendered obvious, suggested, or even implied by any of the prior art tools for installing wallboard and plywood, either alone or in any combination thereof.

It is another object of the present invention to provide a new Apparatus for Assisting the Lifting of Rigid Sheet Materials which may be easily and efficiently manufactured and marketed.

It is a further object of the present invention to provide a new Apparatus for Assisting the Lifting of Rigid Sheet Materials which is of a durable and reliable construction.

An even further object of the present invention is to provide a new Apparatus for Assisting the Lifting of Rigid Sheet Materials which is susceptible of a low cost of manufacture with regard to both materials and labor, and which accordingly is then susceptible of low prices of sale to the consuming public, thereby making such Apparatus for Assisting the Lifting of Rigid Sheet Materials economically available to the buying public.

Still yet another object of the present invention is to provide a new Apparatus for Assisting the Lifting of Rigid Sheet Materials which provides in the apparatuses and methods of the prior art some of the advantages thereof, while simultaneously overcoming some of the disadvantages normally associated therewith.

Still another object of the present invention is to provide a new Apparatus for Assisting the Lifting of Rigid Sheet Materials for lifting and holding a sheet of wallboard or plywood in an elevated position above a bottom board so that it can be nailed in place.

Yet another object of the present invention is to provide a new Apparatus for Assisting the Lifting of Rigid Sheet Materials which includes a foot lever and fulcrum and an extendible lift arm pivotally attached thereto.

Still yet another object of the present invention is to provide a new Apparatus for Assisting the Lifting of Rigid Sheet Materials that easy to use.

Even still another object of the present invention is to provide a new Apparatus for Assisting the Lifting of Rigid Sheet Materials that provides an adjustable extension from 42 inches to 60 inches.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
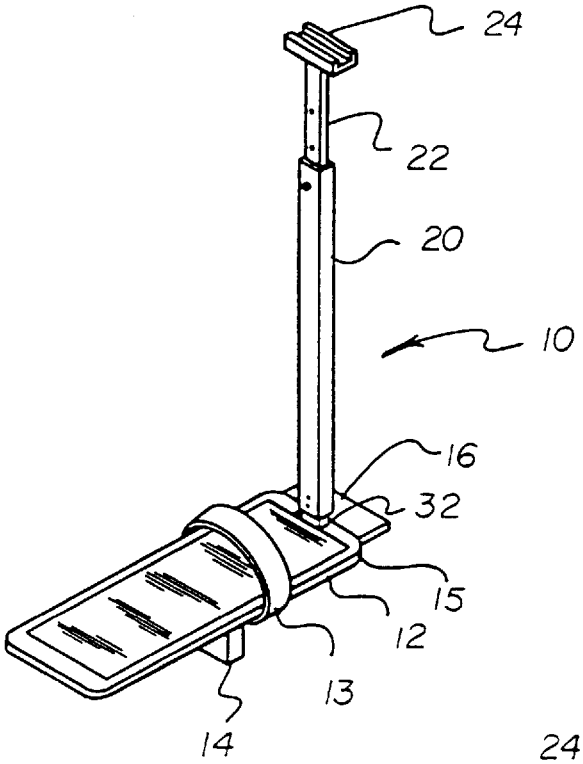
FIG. 1 is a right side perspective view of a new Apparatus for Assisting the Lifting of Rigid Sheet Materials according to the present invention.

With reference now to the drawings, and in particular to FIGS. 1 through 6 thereof, a new Apparatus for Assisting the Lifting of Rigid Sheet Materials embodying the principles and concepts of the present invention and generally designated by the reference numeral 10 will be described.

More specifically, it will be noted that the Apparatus for Assisting the Lifting of Rigid Sheet Materials 10 comprises a foot platform 12 and fulcrum 14 comprising a lever and fulcrum assembly, a tubular rod 20, a means for pivotally attaching the tubular rod to the lever and fulcrum assembly 30 and a lift arm 22 extending through the tubular rod 20.

With reference to FIG. 1, the Apparatus for Assisting the Lifting of Rigid Sheet Materials 10 of the present invention is shown. Foot platform 12 includes a band 13 attached thereto for receiving a front portion of a person's shoe and disposed proximate a lifting assembly including a pivot member 32, tubular rod 20 and lift arm 22. Also shown is a tongue 16 which extends from a foot platform pivot member end and is integral to the foot platform 12.

Figure 2:
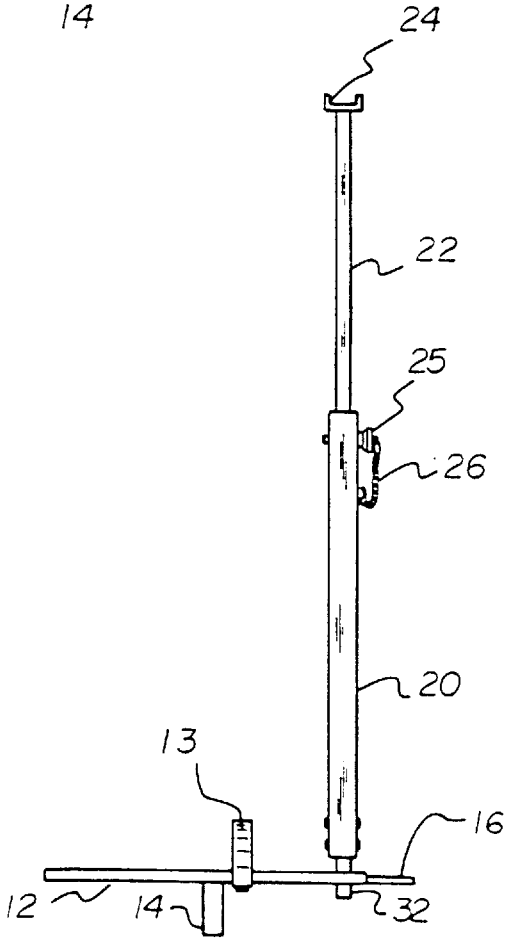
FIG. 2 is a side elevation view thereof.

With reference to FIG. 2, the fulcrum 14 is disposed at a midpoint of the foot platform 12 and may be formed integrally with the foot platform 12. A locking pin 25 is provided including a chain 26 for securing the locking pin 25 to the tubular rod 20.

Figure 3:
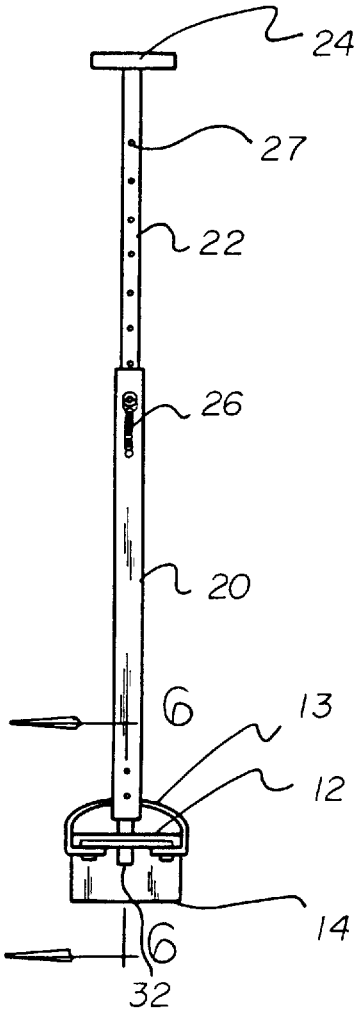
FIG. 3 is a front elevation view of the present invention.
Figure 5:
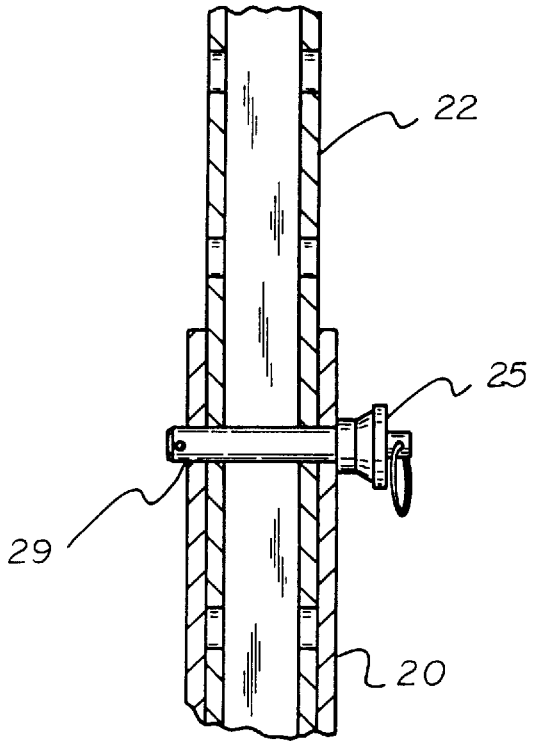
FIG. 5 is a fragmented view of the lift arm showing the locking pin in place.

With reference to FIG. 3, a plurality of positioning apertures 27 are disposed along the lift arm 22 for positioning the lift arm 22 by means of locking pin 25 which is receivable in tubular rod aperture 29 (FIG. 5).

Figure 4:
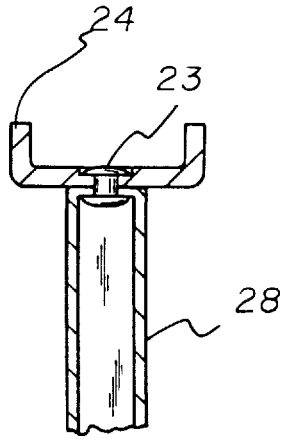
FIG. 4 is a fragmented view showing the lift arm and blade of the invention.

With reference to FIG. 4, an U-shaped blade 24 is pivotally attached to a lift arm top end 28 by means of a rivet 23.

Figure 6:
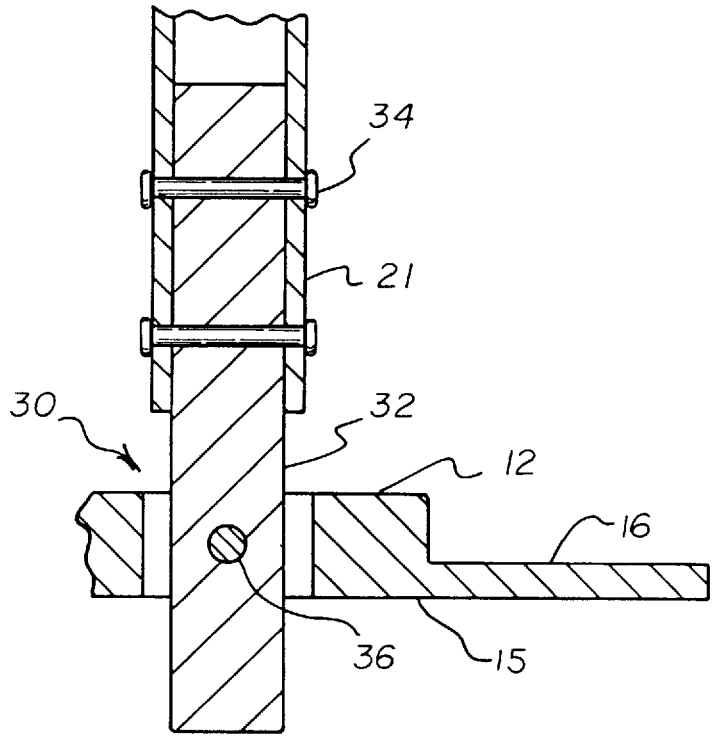
FIG. 6 is a cross sectional view taken along line 6—6 of FIG. 3. 3.

With reference to FIG. 6, the pivot means 30 of the invention is shown including a pivot member 32 pivotally attached to the foot platform 12 by means of pivot pin 36. Pivot member 32 is fixedly attached a bottom end of the tubular rod 21 by means of rivets 34.

In use, a position is selected for the lift arm 22 before a sheet of wallboard or plywood is placed in the U-shaped blade 24. Once the position is selected, locking pin 25 is inserted through tubular rod aperture 29 and the selected positioning aperture 27. A sheet of wallboard or plywood is then placed in the U-shaped blade 24 for positioning above a bottom piece of wallboard of plywood. The person nailing the wallboard or plywood then places their foot upon the foot platform 12 and through the band 13. By applying a force upon the foot platform 12 with their foot the person can lift the sheet of wallboard or plywood for positioning and nailing. Additionally two Apparatus for Assisting the lifting of Rigid Sheet Materials can be utilized for a single sheet of wallboard or plywood if desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patent of the United States is as follows:

1. An apparatus for assisting the lifting of rigid sheet materials comprising:

a lever and fulcrum assembly;

a tubular rod having an interior;

a means for pivotally attaching the tubular rod to the lever and fulcrum assembly;

a lift arm extending through the tubular rod, the lift arm being slidably disposed in the interior of the tubular rod and selectively attachable to the tubular rod at a plurality of positions, the lift arm and the tubular rod forming a lifting assembly of variable length;

wherein the lift arm further comprises a U-shaped blade pivotally attached to a top end of the lift arm adapted to hold a sheet of rigid material in an elevated position; and wherein the lever and fulcrum assembly further comprises an integral fulcrum disposed towards a midpoint of a foot platform whereby the foot platform is used to lever the lifting assembly, the foot platform being connectable to the foot of a user to permit hands-free operation of the apparatus.

2. The apparatus for assisting the lifting of rigid sheet materials of claim 1, wherein the means for pivotally attaching the tubular rod to the lever and fulcrum assembly further comprises a pivot member fixedly attached to a bottom end of the tubular rod, the pivot member being pivotally attached to the lever and fulcrum assembly by means of a pivot pin.

3. The apparatus for assisting the lifting of rigid sheet materials of claim 1, wherein the lift arm is selectively attachable to the tubular rod by means of a locking pin receivable in a plurality of positioning apertures formed in the lift arm and a tubular rod aperture formed in the tubular rod.

4. The apparatus for assisting the lifting of rigid sheet materials comprising:

a lever and fulcrum assembly;

a tubular rod;

a means for pivotally attaching the tubular rod to the lever and fulcrum assembly, wherein the means for pivotally attaching the tubular rod to the lever and fulcrum assembly further comprises a pivot member fixedly attached to a bottom end of the tubular rod, the pivot member being pivotally attached to the lever and fulcrum assembly by means of a pivot pin, wherein the pivot member is fixedly attached to the bottom end of the tubular rod by means of at least two rivets; and a lift arm extending through the tubular rod, the lift arm being selectively attachable to the tubular rod at a plurality of positions and forming a lifting assembly.

5. The apparatus for assisting the lifting of rigid sheet materials of claim 1, wherein the U-shaped blade is pivotally attachable to the top end of the lift arm by means of a rivet.

6. The apparatus for assisting the lifting of rigid sheet materials of claim 1, wherein the lever and fulcrum assembly further comprises a band adapted to receive a front portion of a person's shoe disposed proximate the lifting assembly.

7. An apparatus for assisting the lifting of rigid sheet materials for use in lifting and holding a sheet of wallboard or plywood in an elevated position above a bottom board so that it can be nailed in place, comprising a lever and fulcrum assembly, a tubular rod, a means for pivotally attaching the tubular rod to the lever and fulcrum assembly and a lift arm extending through the tubular rod, the means for pivotally attaching the tubular rod to the lever and fulcrum assembly having a pivot member fixedly attached to a bottom end of the tubular rod, the pivot member being pivotally attached to the lever and fulcrum assembly by means of a pivot pin, the pivot member being fixedly attached to the bottom end of the tubular rod by means of at least two rivets, the lift arm being selectively attachable to the tubular rod at a plurality of positions and forming a lifting assembly, the lift arm further comprising an U-shaped blade pivotally attachable to a top end of the lift arm adapted to hold the sheet of wallboard or plywood in an elevated position whereby through the selection of a suitable position of the lifting assembly and appropriate use of the lever and fulcrum assembly, the sheet of wallboard or plywood can be held in an elevated position above the bottom board and nailed in place.

* * * * *